US005498833A

United States Patent [19]

Huang

[11] Patent Number: 5,498,833

[45] Date of Patent: Mar. 12, 1996

[54] ELECTRIC MUSIC BOX POWERED BY WIND-UP

[75] Inventor: Lung H. Huang, Taichung Hsien, Taiwan

[73] Assignee: Kyooh Precision Industry Co., Ltd., Taipei, Taiwan

[21] Appl. No.: 501,619

[22] Filed: Jul. 12, 1995

[51] Int. Cl.[6] ..... G10F 1/06

[52] U.S. Cl. ..... 84/94.1; 84/600; 446/303

[58] Field of Search ..... 84/94.1, 94.2, 84/95.1, 95.2, 600, 644, 670, 718, 743; 446/303

[56] References Cited

U.S. PATENT DOCUMENTS 5,264,656 11/1993 Itakura et al. ..... 84/600

*Primary Examiner*—Patrick J. Stanzione

*Attorney, Agent, or Firm*—Bacon & Thomas

[57] ABSTRACT

An electric music box powered by wind-up comprises a housing having a rratchetshaft disposed thereof. A wind-up mechanism is enclosed onto the rratchetshaft. A bevel gear is rotated by the rratchetshaft and a transmit group is rotated by the bevel gear. An output shaft and a transmit group is rotated by the bevel gear. An output shaft is connected to the transmit group to generate other movement. A damping shaft is meshed with the transmit group. A wind cap is disposed above the rratchetshaft. A circuit is disposed above the wind cap which is triggered by joint movement of a cam disposed as the top of the rratchetshaft and a controlling plate having a plurality of teeth thereof. The circuit comprises music IC, speaker and a power source. When the music box is triggered to operate, the speaker will announce music. The circuit is connected with LED device to be blinked with music. The output shaft and relevant elements are moved. A cover lid is used to enclose the configuration.

10 Claims, 6 Drawing Sheets

ELECTRIC MUSIC BOX POWERED BY WIND-UP

BACKGROUND OF THE INVENTION

This invention relates to an electric music box, more particularly, to an electric music box powered by wind-up.

DESCRIPTION OF THE PRIOR ART

The conventional music box can be categorized into two types, i.e. the wind-up type and the motorized type, as clearly shown in FIG. 6. Generally, this music box includes a cylindrical drum having a plurality of projections 1 incorporated with a comb-type strings 2 capable of generating different notes once it is triggered. Each and every projections 1 is carefully arranged to trigger said strings 2 to vibrate according a predetermined notes order, consequently, a cyclic notes can be heard as said drum 1 keeps on rotating. Normally, each music box can only generate one music because the projections disposed at the outer surface of said drum 1 is fixed. While the electronics music box can be arranged with a plurality of music, such as 1) music, 2) animal sounds, 3) siren and horn, and 4) synthetic music. On the other hand, the music box with wind-up can not power the LED device to bring a blinking effect accompanied by music. Besides, said drum 1 and said comb strings 2 shall be designed by an expert who is familiar with said art. Not only is the configuration sophisticated, the manufacturing cost is high as well.

SUMMARY OF THE INVENTION

It is the object of this invention to provide an electric music box powered by wind-up which features the advantages of both electric and wind-type. Said music box is still powered by the wind-up and the conventional drum and comb strings mechanism has been beneficially replaced by an integral circuits which provides DC source and pertinent circuits wherein a music IC is connected to said circuit. When the circuit is triggered by said wind-up mechanism, a selected music from said IC is broadcasted through a speaker. Furthermore, each time it may have a specially selected music or sounds. The resulted effect can never be achieved by the conventional music box. On the other hand, the LED devices can be incorporated to said circuit to bring a blinking effect accompanying with the music. On the other hand, the puppet incorporated thereof may also be rotated with the output shaft of the wind-up. This configuration is completely different with the conventional music box with a drum and comb stings which can only generate a piece of cyclic music. Besides, the music box made according to this invention may reduce the manufacturing cost since the drum and comb strings are replaced by an IC which it provides sound and light and motion effects which the conventional music box can never achieve.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF PREFERRED EMBODIMENT

Figure 1:
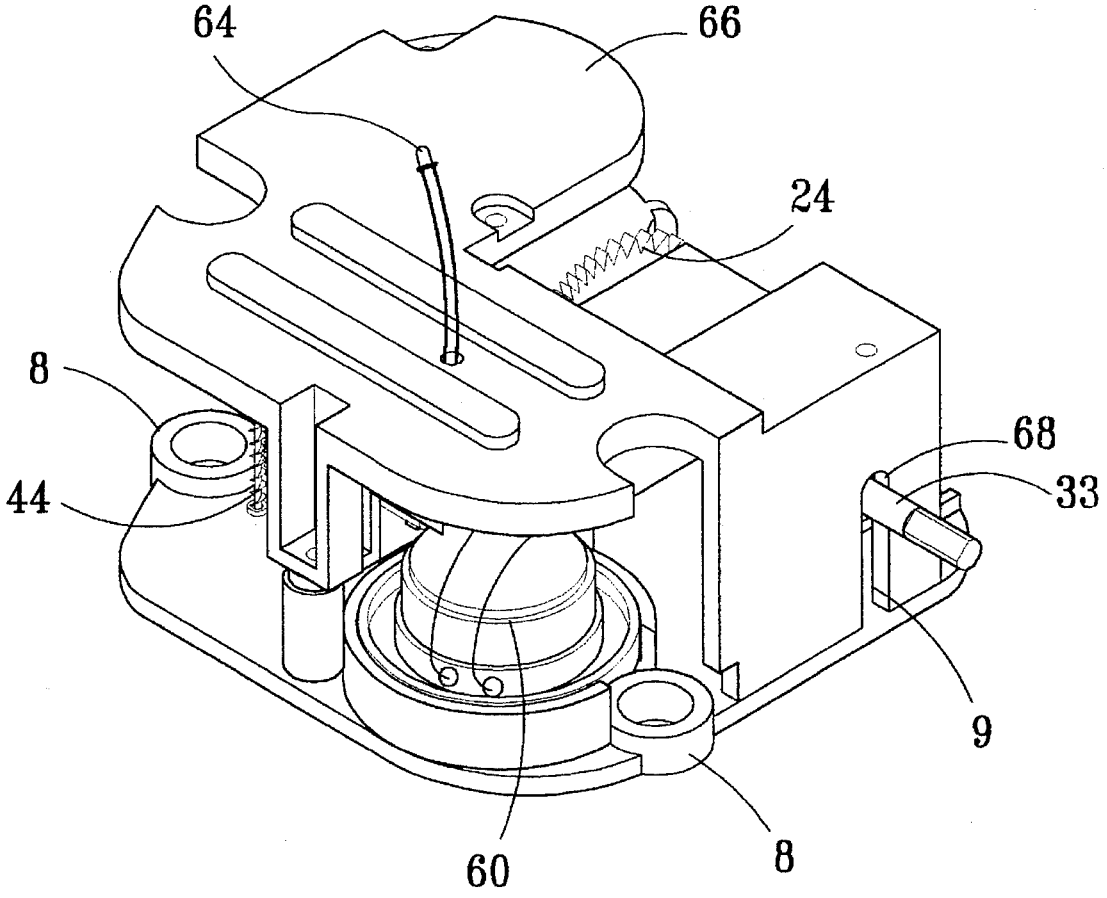
FIG. 1 is a perspective view of the music box made according to this invention.
Figure 2:
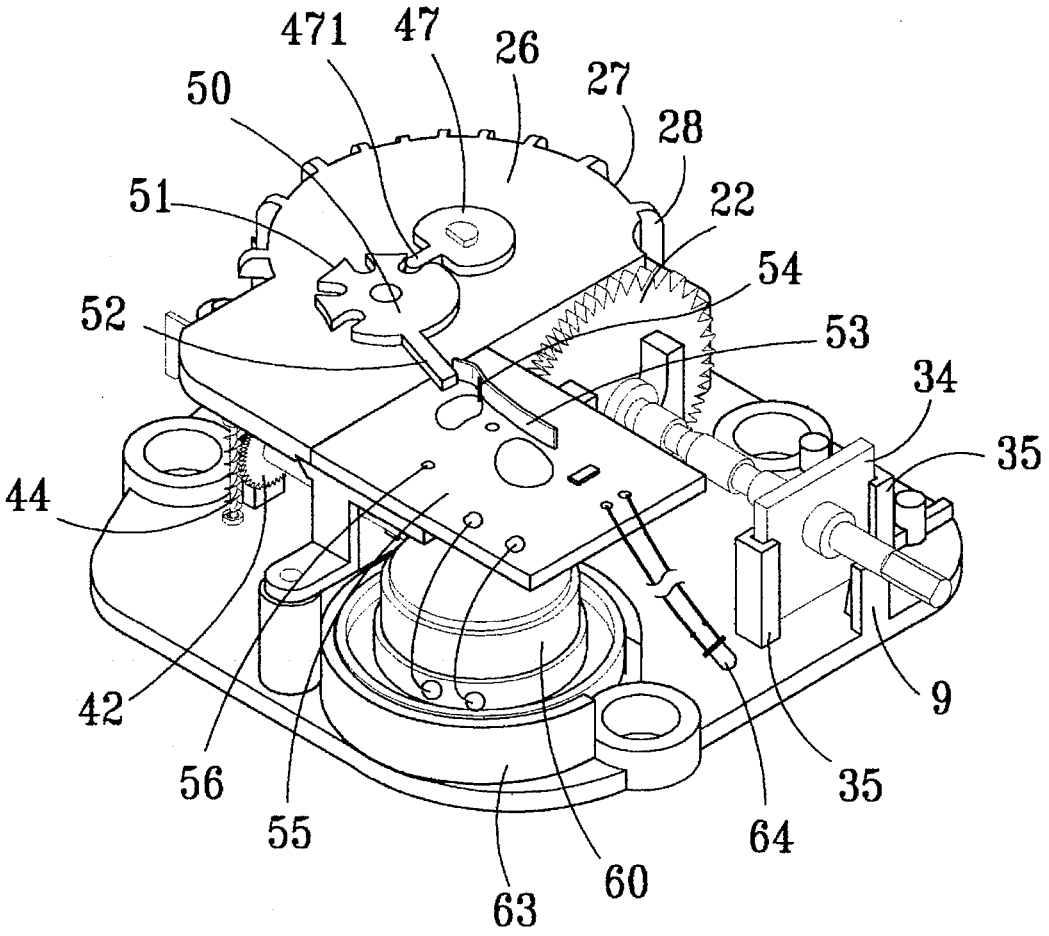
FIG. 2 is similar to FIG. 1 wherein the cover lid is removed and the wind-up is still.
Figure 3:
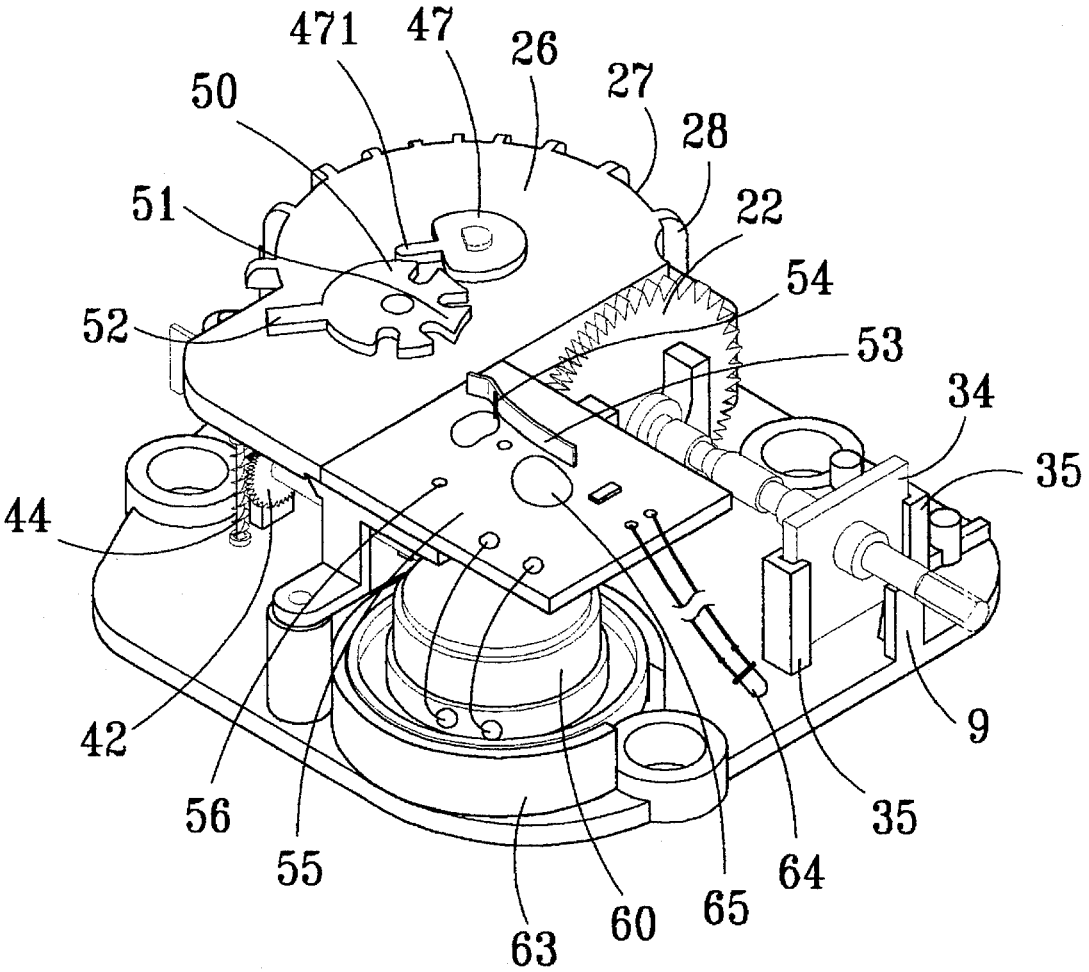
FIG. 3 is similar to FIG. 2 wherein the wind-up is triggered.
Figure 4:
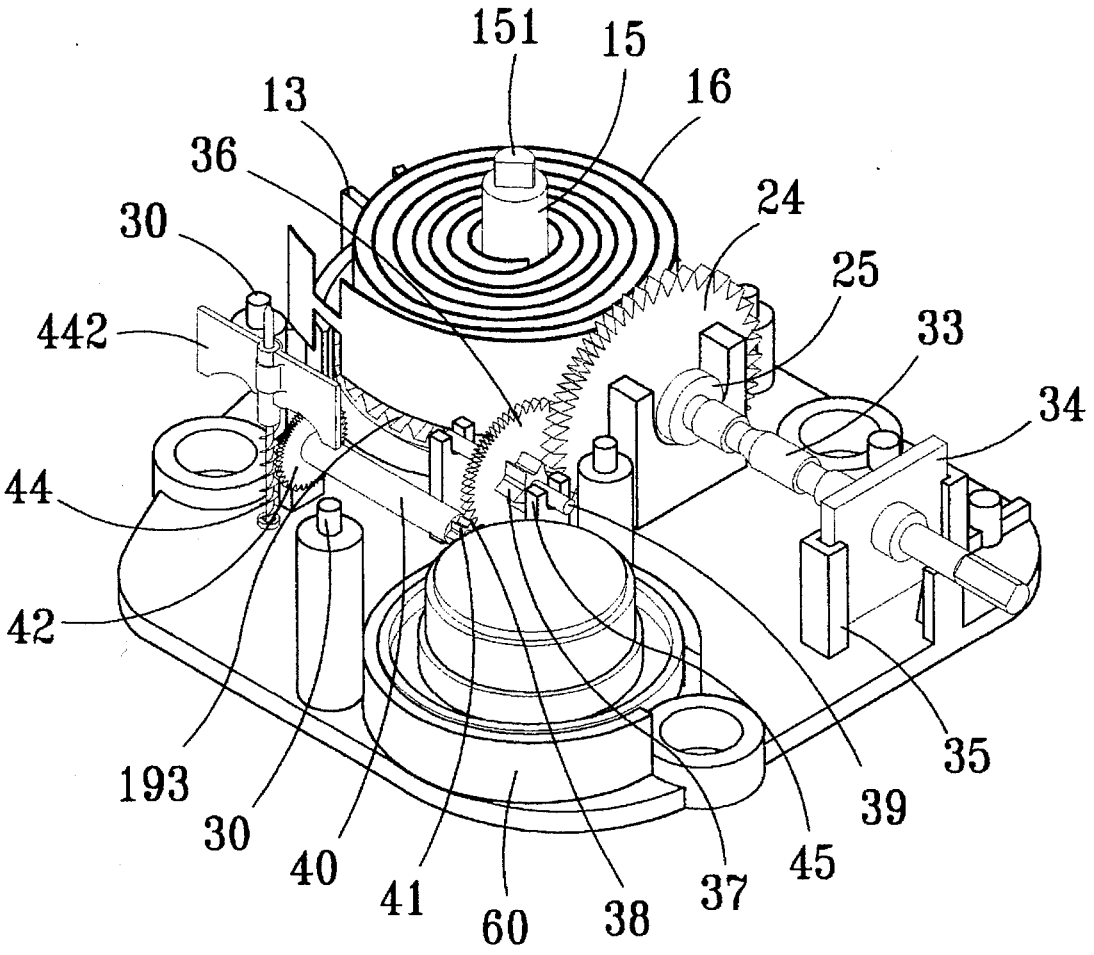
FIG. 4 is a perspective view of the music box wherein the wind-up and the IC circuit is removed.
Figure 5:
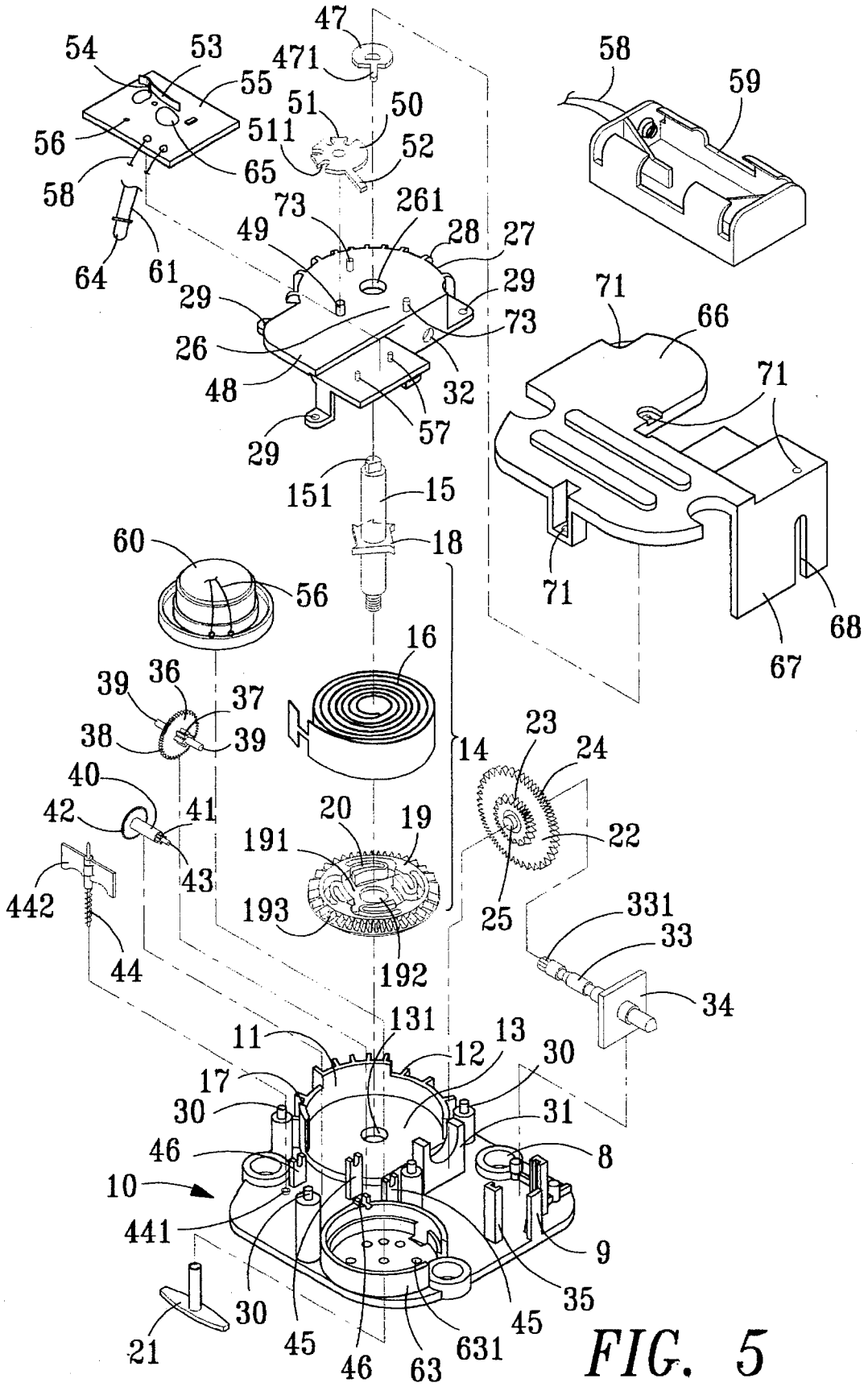
FIG. 5 is an exploded perspective view of the music box made according to this invention.
Figure 6:
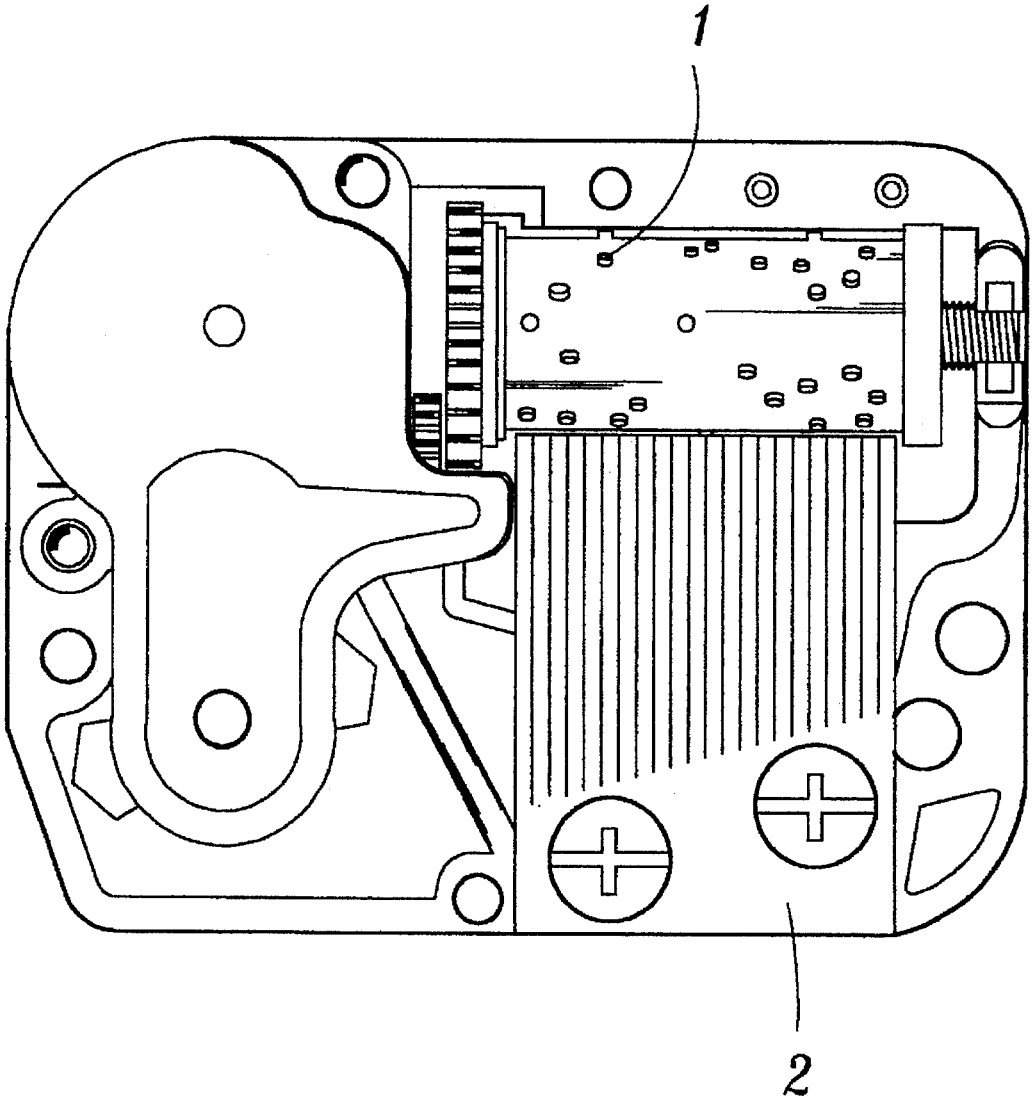
PRIOR ART FIG. 6
FIG. 6 is a top view of a conventional music box.

As shown in FIGS. 1 to 5, the electric music box triggered by wind-up includes a housing 10 having a fixing wall 11 at the upper corner. The outer surface of said fixing wall 11 being provided with a plurality of projected ribs 12 defining a wheel seat 13 thereof. A through hole 131 is provided at wheel seat 13. A wind-up mechanism 14 is disposed within said seat 13. Said wind-up mechanism 14 includes a ratchet shaft 15, a winds 16 and a bevel gear 19. Said winds 16 is round on the upper half of said racket shaft 15 and is enclosed by a wind cap 26. Said cap 26 is configured similar with said fixing wall 11 of said housing 10. The lower part of said cap 26 has also being provided with a fixing wall 27 having projected ribs 28 thereof. A plurality of dowel holes 29 are also provided for interconnected with the dowel 30 of said housing 10.

The outer end of said wind 16 fixed within a slit 17 of said fixing wall 11. Theratchett shaft 15 is provided with a ratchett portion 18. Said ratchett portion 18 is received in a middle portion 191 of said bevel gear 19 rotatably mounted with said seat 13o When the bevel gear 19 is rotated by said ratchet shaft 15, the bevel gear 19 can only rotate unidirection because the ratchet 18 is retained by the ratchet block 20 disposed at middle part 191 of said bevel gear 19.

The lower part of said ratchet shaft 15 passes the bevel gear 192 and the through hole 131 of said seat 13, then is interconnected with a T-handle 21. When the T-handle 21 is rotated, the ratchet shaft 15 is rotated and said winds 16 is tightened. When the T-handle 21 is released, the potential energy of said winds 15 will mobilize said ratchet shaft 15 and said bevel gear 19 to rotate.

The teeth 193 of said bevel gear 19 is meshed with the pinion 23 of the first transmit group 22. Accordingly, said first transmit group 22 is rotated accordingly. Said first transmit group 22 includes a big gear 24 having a shaft 25 in the central portion. The shaft portion 25 of said big gear 24 is rotatably bridged between the bracket 25 of said housing 10 and hole 32 of wind cap 26. Said big gear 24 is then installed onto an output shaft 33 by the engagement between said the elongate teeth portion 331 of said output shaft 33 and the elongate portion disposed within the central hole of said first transmit group 22.

Said output shaft 33 is provided with a clipping bracket 34 to be received within a fixing frame 35 of said housing 10. Accordingly, said output shaft 33 is extended beyond the housing 10. The power transmitted thereof can be used to mobilize other mechanism, such as the bouncing and rotating of a puppet.

The big gear 24 of said first transmit group 22 is meshed with the pinion 37 of the second transmit group 36 and the big gear 38 of the second transmit group 36 is meshed with the pinion 41 of the third transmit group 40. the big gear 42 of said third transmit group 40 is meshed with a damping shaft 44. The shaft 39 of said second transmit group 40 is bridged between a pair of supports 46. The shaft 43 of said third transmit group 40 is bridged between a pair of supports 46. And the damping shaft 44 is vertically disposed between a seat 441 of said housing 10 and an extension 48 of said wind cap 26.

When the wind 16 is released, the potential energy is transmitted to damping shaft 44 by means of said first, second and third transmit groups. Said damping shaft 44 will stand still only when the potential energy of said winds 166 is completely exhausted. In order to attenuate the rotating speed off said damping shaft 44, said damping shaft 44 is provided with projected fins 442 to increase the air drag to decrease the rotation of said damping shaft 44.

The top portion of said ratchet shaft 15 has a projected joint 151 which extends beyond the hole 261 of said winds cap 26. A cam 47 having a shank 471 is attached to said joint 151. When the winds 16 is not tightened up, the shank 471 of said cam 47 is meshed with the root of the teeth 51 of a control plate 50. Said control plate 50 has an extension 52. When said winds 16 is not ready to release energy, said extension 52 will press against a conductor 53 of a circuit board 55 away from the contact 54 of said circuit board 55, accordingly, a close-loop is not established. When the T-handle 21 rotates one round, said winds 16 is tightened one round, said teeth 51 of said controlling plate 50 is moved one further step by the help of said shank 471 of said cam 47. In fact, the outer diameter of said top 511 of said teeth 51 is eccentric with the diameter of said cam 47, accordingly, the cam 47 rotates one round, the teeth 51 of said controlling plate 50 move one step.

Said circuit board 55 has a pair of holes 56 connected to a joint shaft 57 of an extension 48 of said wind cap 26. Said circuit board 55 is electrically connected to a battery cartridge 59 via a pair of wires 58. As a result, the AC power from said battery cartridge 59 is sent to said circuit board 55. A speaker 60 is electrically connected to said circuit board 55 with a pair of wires 61. Said speaker 60 is disposed within a holder 63 located at the lower right corner of said housing 10. Said housing 10 is also provided with a plurality of music holes 631. Said circuit board 55 can also be disposed with LED device 64. A music IC 65 is interconnected with said circuit board 55.

In operation, said contact 54 is triggered as the T-handle 21 is rotated, accordingly, said extension 52 of said controlling plate 50 is removed to release the conductor 53. A close-loop is established between said contact 54 and said conductor 53. Then, the AC power from said battery cartridge 59 is sent to said circuit board 55. Then the music IC 65 is triggered and a selected music is broadcasted from said speaker 60. Basically, the music IC 65 is different with the ROM and which can announce one to several music or even trigger said LED device 64. By the way, the output shaft 33 is moved accordingly.

When the potential energy of said winds 16 is completely exhausted, said extension 471 of said cam 47 brings back said teeth 51 of said controlling plate 50, then the transmit group 14 is ceased to moved. Then an open circuit will be established between said contact 54 and said conductor 53 by the help of extension 52 of said controlling plate 50. The power is interrupted and the music and LED are stopped accordingly.

The most important design is on said cam 47 and the teeth design of said controlling plate 50. The number of said teeth also plays an important role on it. The design shall be in such a manner that when said transmit group is ceased to move, the music and the LED device shall be ceased simultaneously.

Even each music box is incorporated with an identical winds, when the winds is tightened up, the rotations which the transmit group runs are different because the interference between the gears. Accordingly, little difference will be found among the music boxes. In actual design, the number of the teeth of said controlling plate 50 is smaller that the wound of said winds 16, by this arrangement, the rotations of said wind-up and the rotations released therefrom are consistent. As a result, once the potential energy is exhausted, the sound and the LED device are stopped simultaneously with said transmit group 14.

At last, a cover lid 66 is applied to enclose the output shaft 33. Said cover lid 66 is arranged in such a manner that it can be disposed onto said housing 10, wherein said output shaft 33 is covered by a skirt 67 having a slot 68 defining a passage for said output shaft 33. Besides, said skirt 67 is disposed within said fixing frame 35 and a post 9. On the other hand, said cover lid 66 is provided with a plurality of joint holes 71 to be interconnected with a plurality of retaining posts 72 of said housing 10 as well as the retaining post 73 of said wind lid 26.

On course, the music IC can also be arranged to announce language to increase its functions. This language can also be incorporated with the music and sounds memorized within said music IC. By this arrangement, the consumer can enjoy a more pleasant music box. No doubt, the level which the present invention now stands is unreachable for the conventional art.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An electric music box powered by wind-up comprising a housing having a wind-up mechanism thereof, said wind-up mechanism including a ratchet shaft, a bevel gear and a winds, said winds being enclosed at said ratchet shaft and being enclosed by a wind cap, when said winds being rotated to tighten and release its potential energy, said ratchet shaft and said bevel gear being rotated therefrom, said bevel gear being meshed with a damping shaft to decrease the rotating speed of said ratchet shaft; said ratchet shaft being extended above said wind cap and being interconnected with a cam, said cam being provided with a shank which can be interfered with a controlling plate having an extension thereof, said controlling plate being provided with a plurality of teeth thereof, when said cam rotates one round, said tooth of said controlling plate moves one step, said extension of said controlling plate being prevented from contact with the contact of a circuit board, when said cam is moved, said extension of said controlling plate being contacted with said contact of said circuit board, said circuit board being provided with music IC and being electrically connected with a power source and a speaker, said speaker being powered to broadcast music, a cover lid being used to enclose the winds cap and output shaft.

2. A music box as recited in claim 1, wherein a LED device is interconnected with said circuit board, said LED device is operated with said music.

3. A music box as recited in claim 1, wherein when the transmit group is ceased to perate, the music and the blinking of said LED are ceased simultaneously by the arrangement of said cam and said controlling plate having a plurality of teeth; said top of said controlling plate is eccentric to said outer diameter of said cam.

4. A music box as recited in claim 1, wherein the number of said teeth of said controlling plate is smaller than said winds and is not limited by the number of said teeth of said controlling plate, accordingly, said wind-up can be wound up completely.

5. A music box ass recited in claim 1, wherein said circuit board is interconnected and powered by a battery cartridge via a pair of wires.

6. A music box as recited in claim 1, wherein the left upper corner of said housing is provided with an fixing wall having a projected ribs, a seat is defined therein for disposing a bevel gear thereof, said bevel gear is provided with a through hole defining a passage for said ratchet shaft.

7. A music box as recited in claim 1, wherein the winds cap which is similar to said housing is provided with fixing wall at the right upper corner, said fixing wall is also being provided with a projected ribs thereof, a plurality of dowel holes and retaining posts are incorporated for engagement there between, an extension is provided at the left side of said wind cap.

8. A music box as recited in claim 1, wherein said transmit group is connected with an output shaft, said shaft is provided with fixing plate to be received within a fixing frame of said housing, said output shaft is interconnected with other mechanism by an extension extended beyond said housing.

9. A music box as recited in claim 1, wherein said a cover lid is applied to enclose the output shaft, said cover lid is arranged in such a manner that it can be disposed onto said housing wherein said output shaft is covered by a skirt having a slot defining a passage for said output shaft, besides, said skirt is disposed within said fixing frame and a post, said cover lid 66 is provided with a plurality of joint holes to be interconnected with a plurality of retaining posts of said wind lid.

10. A music box as recited in claim 1, wherein said music IC can be included with a plurality of music and languages.

* * * * *